US005151051A

United States Patent [19]

Nagamine

[11] Patent Number: 5,151,051

[45] Date of Patent: Sep. 29, 1992

[54] CONNECTOR LATCH WITH ANTI-OVERSTRESS

[75] Inventor: Akira Nagamine, Kawasaki, Japan

[73] Assignee: AMP Incorporated, Harrisburg, Pa.

[21] Appl. No.: 835,788

[22] Filed: Feb. 14, 1992

[30] Foreign Application Priority Data

Feb. 28, 1991 [JP] Japan ..... 3-16512[U]

[51] Int. Cl.[5] ..... H01R 13/74

[52] U.S. Cl. ..... 439/557; 439/572; 439/556

[58] Field of Search ..... 439/556, 557, 559, 562, 439/567, 572

[56] References Cited

U.S. PATENT DOCUMENTS 4,154,498 5/1979 Wood et al. ..... 439/557

4,924,561 5/1990 Yoneyama ..... 439/557 X 5,015,203 5/1991 Furrow ..... 439/557 X

*Primary Examiner*—Eugene F. Desmond

*Attorney, Agent, or Firm*—Adrian J. LaRue

[57] ABSTRACT

A panel mounted electrical connector includes a plastic housing with flexible latches that are driven inwardly as the connector is forced into an aperture in a panel and spring outwardly to engage the edge of the panel aperture to hold the connector in place. The latches include interior recesses containing surfaces engaged by an integral stop contained entirely within the profile of the recesses to limit bending of the latches and resulting failure caused by pulling loads applied to the connector. The latches and stops have a configuration facilitating the provision of applying a sealing member onto the panel and the connector.

8 Claims, 3 Drawing Sheets

CONNECTOR LATCH WITH ANTI-OVERSTRESS

This invention relates to an electrical connector of the panel mounting type having latches with anti-overstress features.

BACKGROUND OF THE INVENTION

Panel mounted electrical connectors that have integral resilient latches positioned to be cammed inwardly upon insertion of the connector through the aperture of a panel to snap outwardly and latch the connector housing to the panel are well known. Experience with such structures has revealed that problems exist with relation to latch breakage if the latch is made too fragile and difficulty of insertion if the latch is made too strong. To accommodate such problems, latches may be tied in with projections that give support to the latches. One additional problem is that such additional support occupies a length along the connector housing which makes sealing of the panel mounted connector difficult.

Accordingly, it is an object of the present invention to provide an improved connector latch having an anti-overstress feature. It is a further object of the invention to provide an anti-overstress latch of a configuration fitting entirely within the aperture and on one side of a panel to facilitate sealing applied to the other side of the panel. It is yet a further object to provide a simple, moldable latch and stop facilitating easy insertion of a connector and resisting unintended withdrawal relative to a panel.

SUMMARY OF THE INVENTION

The present invention achieves the foregoing objectives and overcomes the problems of the prior art through the provision of an integrally molded connector housing having latches extending from the sides thereof adapted to be cammed inwardly upon the insertion of the connector housing through the aperture of a panel. As the housing is pushed through the aperture, camming surfaces on the latches drive the latches inwardly until the latches pass through the aperture and engage the edge of the aperture on the other side of the panel. The latches include oppositely oriented sloped edges which catch upon the edge of the aperture of the panel to resist withdrawal of the connector housing by forces pulling on the housing in a sense to remove it. Each latch includes a hinge facilitating deflection of the latch and the camming and sloped surfaces facilitating insertion and resisting removal. Each latch has an interior recess extending through the ear, which recess has a T-shaped cross-section. A stop of a smaller T-shaped cross-section extends from the housing into the interior of the latch and operates to engage interior surfaces of the latch to preclude bending of the latch upon pulling forces applied to the connector housing. At the same time, the interior configuration of the recesses allows the relative movement of the latch notwithstanding the presence of the stop interiorly thereof during insertion of the connector within an aperture of a panel. The configuration of the latch and the stop are such as to keep the face of the panel clear of latch material to facilitate the application of sealing material following insertion and latching of the connector in place within the panel.

IN THE DRAWINGS

The invention will now be described by way of example with reference to the accompanying drawings in which.

DETAILED DESCRIPTION OF THE INVENTION

Figure 6:
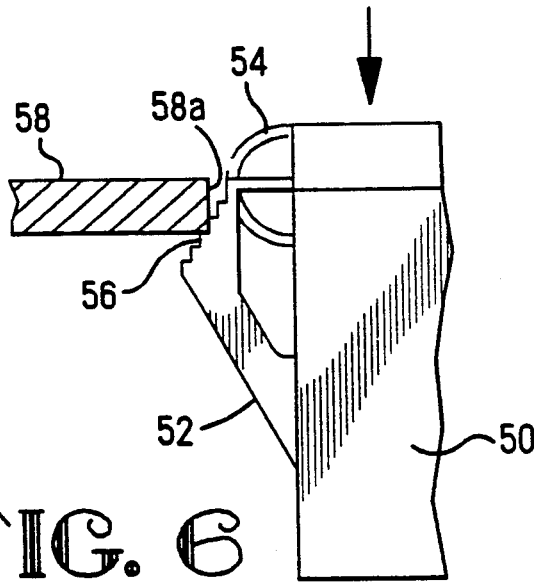
FIG. 6 (Prior Art)
FIG. 6 is a partial top view of a conventional prior art connector, latch and panel.

Referring first to FIG. 6 and a version of a prior art electrical connector latch, a connector housing 50 is shown to include on a side wall a latch 52 in relation to a panel 58, it being understood that only one-half of the connector half is shown relative to one-half of a panel. Typically housing 50 is formed of a plastic material which has elastic characteristics so that the latch 52 is resilient. Upon insertion of the housing 50 along the axis indicated by the arrow, the latch 52, through an outer sloped surface, will engage the edge of the aperture 58*a* and be driven elastically inwardly until such point as the latch end passes through the aperture 58*a*. In accordance with an aspect of prior art latches, a series of steps 56 are provided on the end of the latch to accommodate to an edge corner of the inner side of the panel aperture 58*a*. Upon a reversal of forces tending to pull the housing 50 in an opposite direction out of the panel, the tendency of the latch is to be opened outwardly to a point of failure if the pulling force is sufficient. To that end, the prior art has employed a number of approaches, including providing a strap-like element 54, three possible positions of element 54 being shown which will preclude the latch 52 from outward or inward displacement in failure due to the forces applied. It is to be observed that the latch 52 includes portions which project beyond the inner face of panel. This would make sealing of the connector difficult due to the presence of the latch or portions thereof on both sides of the panel.

Figure 1:
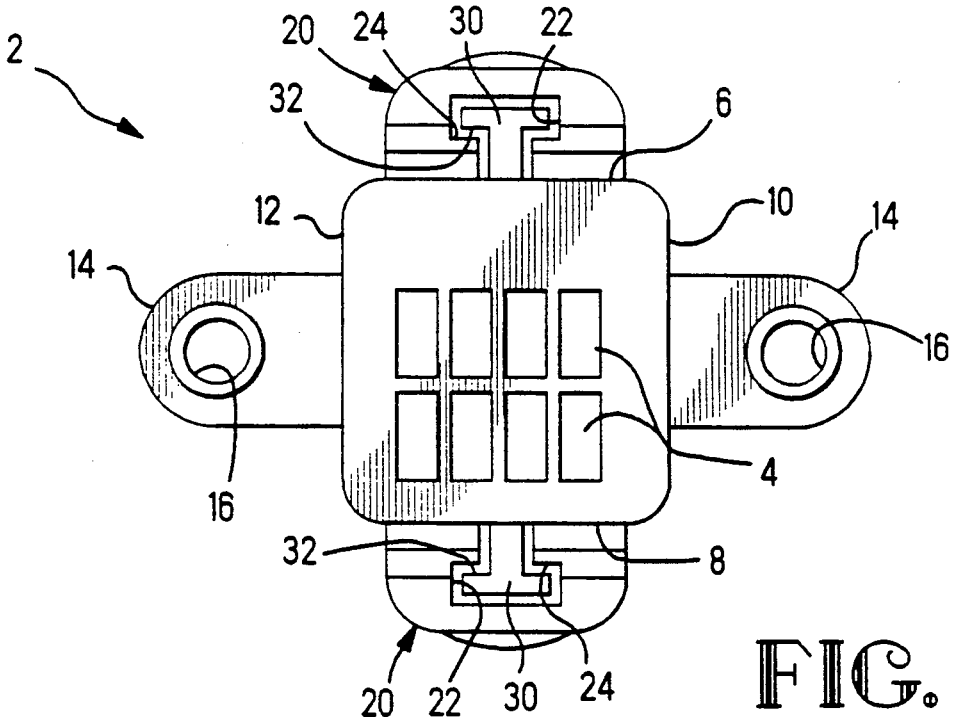
FIG. 1 is a front end view of a connector housing in accordance with the invention.
Figure 2:
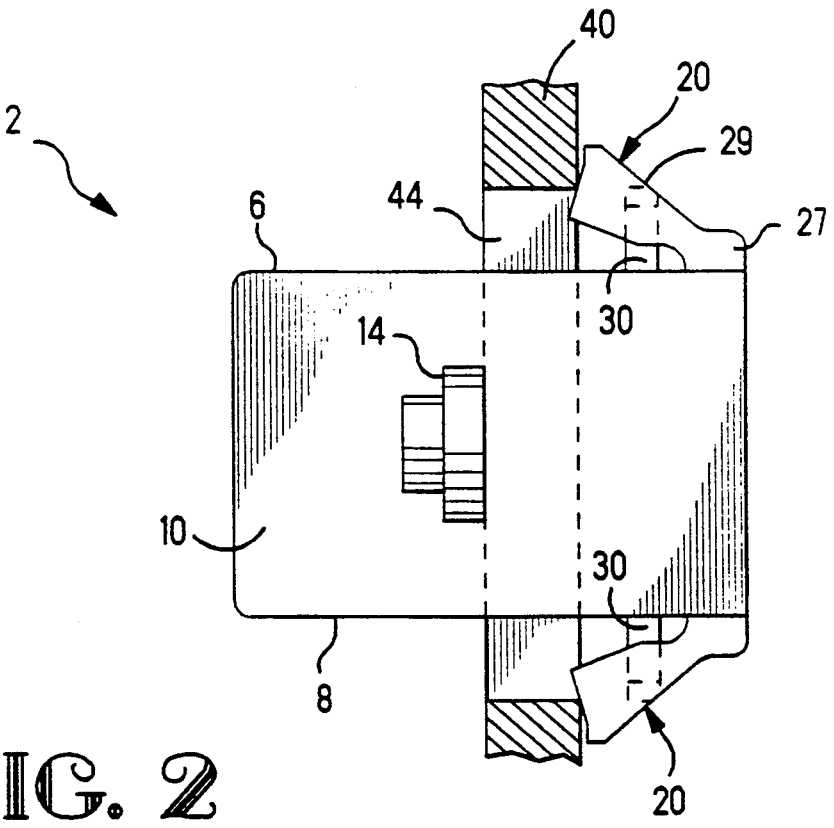
FIG. 2 is a side view of the housing shown in FIG. 1 with a panel and aperture shown in phantom.
Figure 3:
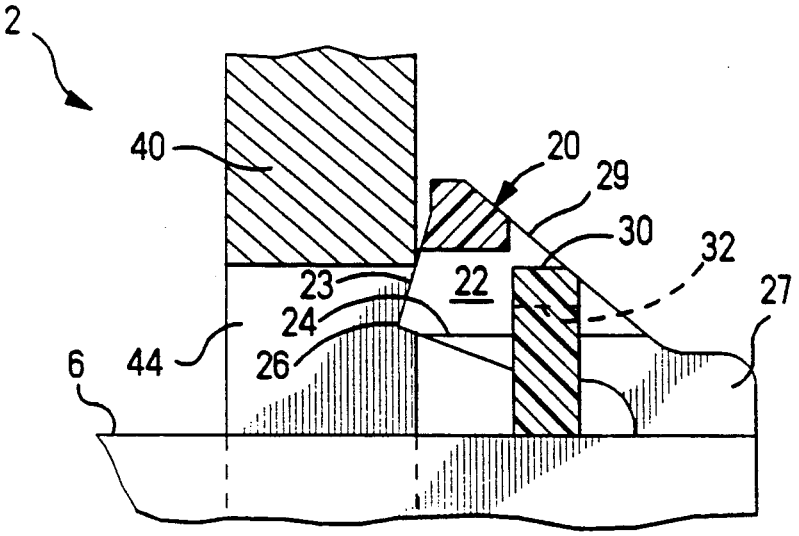
FIG. 3 is a side and sectioned detail of the latch and panel of the invention with the connector in place in the panel.
Figure 4:
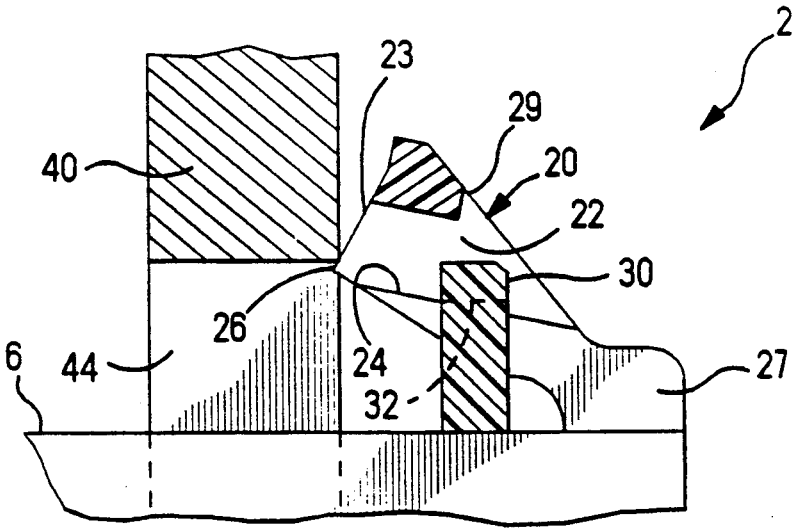
FIG. 4 is a side and sectioned view of the elements shown in FIG. 3 responsive to pulling forces being applied to the connector housing of the invention.

Referring now to FIGS. 1 and 2, an electrical connector is shown to include a housing 2 formed of one-piece plastic-molded material having suitable dielectric and insulating qualities, numerous engineering plastics being available and well-known for such purpose. The housing 2 includes a series of cavities 4 that accommodate electrical terminals, not shown, that connect with matable terminals, either in some electronic device or a further connector. The housing 2 includes sides 6, 8, 10, and 12 forming a generally box-like structure with mounting ears 14 extending from sides 10 and 12 and latches 20 extending from sides 6 and 8. The ears 14 include apertures 16 that optionally allow fasteners to be fitted, locking the housing 2 to a panel once the connector is snapped in place. The panel 40 is shown in FIG. 2 to include a central aperture 44 through which the housing is inserted. As shown also in FIG. 2, the ears 14 engage the entering side of the panel with the latches 20 engaging the edge of aperture 44 on the other side of the panel 40. FIGS. 3 and 4 also show the latch engagement with the edge of panel aperture 44.

Each of the latches 20 includes an interior recess 22 which can be seen in FIG. 1 to have a general T-shape profile including bottom surfaces 24 which extend along the latch. As can be seen in FIGS. 3 and 4, the recesses 22 extend through the latches providing openings from front and rear sides of the latches.

Each latch 20 includes a rearward facing surface 23 which is sloped in the manner indicated in FIGS. 3 and 4 and positioned to engage an edge of the panel aperture 44. A front surface 29 of each latch is also sloped to provide a camming surface to drive the latch inwardly upon insertion, and there is provided an integral hinge portion 27 which facilitates a movement of the latch inward. The free end of the latch 20 joins the section of the latch. Interiorly of recess 22 and extending within the latch 20 is a stop 30 that has a smaller T-shaped profile as shown in FIG. 1. The stop 30, as can be seen in FIGS. 3 and 4, resides entirely within the side profile of the latch 20. Also to be noted is the position of the stop 30 and latch 20 with respect to residing entirely within the aperture 44 and on one side of panel 40 contrasting to the latch of the prior art shown in FIG. 6 which extends on both sides of the panel.

In practice, the housing 2 is inserted through the aperture with the latches 20 springing outwardly to the position shown in FIGS. 2 and 3 to effectively preclude normal forces from pulling the housing 2 back through the aperture 44. The ears 14 preclude forward movement of the housing, and the housing is thereby latched in place for use.

In the event of relative displacement caused unintentionally which tends to pull the housing 2 out of the aperture 44 of panel 40, a force along the axis opposite to the axis of insertion, the interior surface 32 of stop 30 will engage the surface 24 of the latch recess 22 to preclude outward displacement of the latch to a point of damaging of the latch. FIG. 4 shows such a condition with the engagement of surface 32 and surface 24 blocking bending of the latch responsive to such forces.

Figure 5:
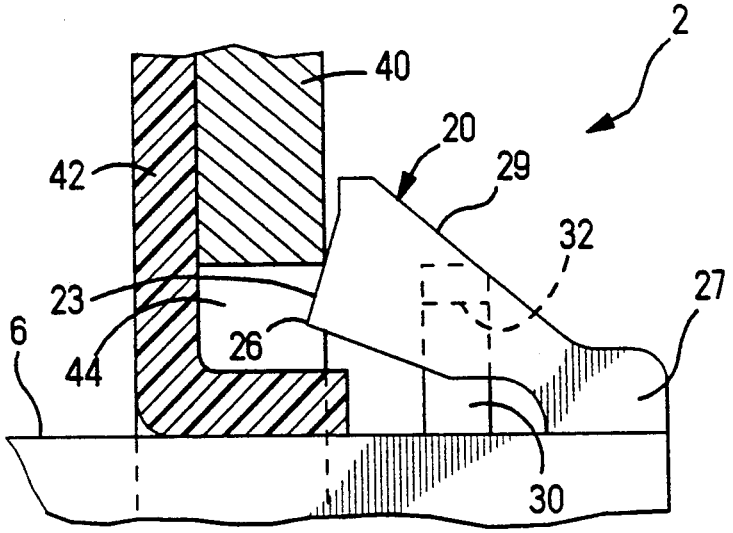
FIG. 5 is a view of the elements shown in FIGS. 3 and 4 with the further application of a sealing material to the connector housing and panel

FIG. 5 shows a further example and advantage of the latch with respect to the addition of a sealing member 42 which is extended along the surface of panel 40 and down against the surface 6 of housing 2 to seal the connector. As can be observed through comparing FIGS. 5 and 6, a seal may be readily applied to the connector of the invention whereas applying a seal to the connector shown in FIG. 6 would be difficult.

Also to be appreciated is the fact that the latch and stop mechanism of the invention is readily moldable in small size connectors, the open nature of the interior recess facilitating the entry of mold parts to effect such.

While the preferred embodiment features two latches, the invention contemplates use of one or more than two latches dependent upon connector profile, size and aperture shape and thickness.

Having now described the invention relative to drawings intended to explain the functioning thereof, claims are appended intended to define what is inventive.

I claim:

1. An electrical connector housing of a type intended to be mounted in the aperture of a panel including a body of resilient plastic material, at least one latch integrally formed with the material of the housing to include a flexible hinge supporting an ear having a surface engaging the panel to latch the housing thereto, the hinge being elastically deflected to facilitate insertion of the housing as pushed through the aperture of the panel, characterized in that said latch includes an interior recess having an interior surface and the housing includes an integral stop residing within said interior recess and positioned to engage the surface and limit bending deflection of the said latch responsive to forces pulling said housing out of said aperture.

2. The connector housing of claim 1 characterized in that said latch includes a camming surface engaging an edge of the aperture to cam the latch inwardly and deflect the hinge elastically upon insertion of the housing into the aperture of the panel.

3. The housing of claim 1 characterized in that said latch includes a sloped surface positioned to engage an edge of the aperture of the panel to hold the housing within the panel.

4. The housing of claim 1 characterized in that said recess has a T-shaped profile and said stop has a smaller T-shaped profile extending within the recess.

5. An electrical connector including a housing of resilient plastic material having a profile to be pushed through an aperture in a panel for panel mounting, and latches integrally formed from the housing material including hinges and ears extending from the sides of the said housing to engage said panel and latch the housing in the aperture thereof to resist removal of the housing against pulling forces applied thereto characterized in that the latches include interior recesses and have interior stops projecting interiorly of the recesses to engage the latches and reduce bending of the latches responsive to forces pulling the said housing out of said panel and further with said latches and stops having a configuration to reside within said aperture and on one side of the said panel to facilitate a sealing member being applied to the other side of said panel and in engagement with said housing.

6. An electrical connector for latchable mounting in an aperture of a panel, comprising:

a dielectric housing;

integral latch means resiliently extending outwardly from said housing and being movable toward said housing when the housing is inserted into the panel aperture and springing outwardly engaging an edge of the aperture thereby latching the housing to the panel, said latch means having internal recess means and stop surface means; and stop means on said housing disposed within said recess means and engagable with said stop surface means to prevent said latch means from bending beyond the engagement of the stop surface means with the stop means when a force is applied to the housing opposite to the direction of insertion of the housing into the panel aperture.

7. An electrical connector as claimed in claim 6, wherein said recess means and said stop means have a T-shaped configuration.

8. An electrical connector as claimed in claim 6, wherein said latch means having camming surfaces and aperture-engaging surfaces.

* * * * *